US012685897B2

(12) United States Patent
Dimmig et al.

(10) Patent No.: US 12,685,897 B2
(45) Date of Patent: Jul. 21, 2026

(54) AUTOMATIC LAP MARKING

(71) Applicant: SRAM, LLC, Chicago, IL (US)

(72) Inventors: Brent Dimmig, Lancaster, PA (US); Cole Stoltzfus, Colorado Springs, CO (US); Stephen Winchell, Brooklyn, NY (US); William Tribble, New York City, NY (US)

(73) Assignee: SRAM, LLC, Chicago, IL (US)

( * ) Notice: Subject to any disclaimer, the term of this patent is extended or adjusted under 35 U.S.C. 154(b) by 263 days.

(21) Appl. No.: 18/315,565

(22) Filed: May 11, 2023

(65) Prior Publication Data

US 2023/0372777 A1 Nov. 23, 2023

Related U.S. Application Data

(60) Provisional application No. 63/344,484, filed on May 20, 2022.

(51) Int. Cl.
*A63B 24/00* (2006.01)

(52) U.S. Cl.
CPC ..... *A63B 24/0021* (2013.01); *A63B 24/0062* (2013.01); *A63B 2024/0025* (2013.01); *A63B 2220/12* (2013.01); *A63B 2220/16* (2013.01); *A63B 2220/17* (2013.01); *A63B 2220/20* (2013.01)

(58) Field of Classification Search
CPC ..... A63B 24/0021; A63B 2024/0025; A63B 2220/12; A63B 2220/16; A63B 2220/17; A63B 2220/20
See application file for complete search history.

(56) References Cited

U.S. PATENT DOCUMENTS

| | | | | |
|---|---|---|---|---|
| 6,837,827 | B1 * | 1/2005 | Lee | A63B 24/0084 482/3 |
| 6,876,947 | B1 * | 4/2005 | Darley | G01P 1/023 702/144 |
| 10,488,527 | B2 * | 11/2019 | Venkatraman | A61B 5/1123 |
| 10,888,735 | B2 * | 1/2021 | Clark | A63B 60/46 |

(Continued)

FOREIGN PATENT DOCUMENTS

| | | |
|---|---|---|
| CN | 103191557 | 7/2013 |
| CN | 109107093 | 1/2019 |
| EP | 2295937 | 3/2011 |

*Primary Examiner* — Jeffrey K Wong

(57) ABSTRACT

A method for identifying a completed lap at a device is disclosed. An example method includes retrieving or defining lap initiation data that can include an initiation location and an initiation orientation. The method also includes retrieving or defining a location variance threshold for the initiation location and an orientation variance threshold for the initiation orientation. The method further includes determining, by a position determining module of the device, a first location of the device associated with a first time. The method also includes determining, by an orientation determining module of the device, a first orientation of the device associated with the first time. The method also includes identifying a lap as completed upon determining that the first location of the device is within the location variance threshold of the initiation location and that the first orientation of the device is within the orientation variance threshold of the initiation orientation.

17 Claims, 4 Drawing Sheets

(56) References Cited

U.S. PATENT DOCUMENTS

| | | | | |
|---|---|---|---|---|
| 2011/0130643 | A1* | 6/2011 | Derchak | A63B 24/0006 600/534 |
| 2017/0039870 | A1* | 2/2017 | Ellis | G09B 9/04 |
| 2018/0147445 | A1* | 5/2018 | Peters | G09B 19/0038 |
| 2021/0093917 | A1* | 4/2021 | Dervisoglu | A63B 24/0062 |
| 2021/0140794 | A1* | 5/2021 | Niu | A63B 24/0062 |
| 2021/0306811 | A1* | 9/2021 | Hapola | H04W 4/027 |

* cited by examiner

AUTOMATIC LAP MARKING

This application claims the benefit of U.S. Provisional Patent Application No. 63/344,484, filed May 20, 2022, which is hereby incorporated by reference in its entirety.

FIELD OF THE INVENTION

The present disclosure relates generally to marking laps in a circuit in a geolocation device or cycling computer.

BACKGROUND

Having properly marked laps and splits is important for cyclists and their coaches to compare subsections of races, both during and afterward. Manually marking laps and splits correctly during a race is difficult and dangerous, and therefore several automated methodologies exist for marking laps. However, creating laps at preset distances or times doesn't result in the properly marked laps because each lap iteration may vary due to routes within a path, such as how a rider approaches a particular turn. Because of this, marking laps when a rider passes a given position is important.

Typically, detection of a new lap is done by observing when a rider's position passes near the point within a certain limited distance threshold. When automatically marking laps by position, a distance threshold that ensures all laps are properly marked should be chosen to account for: riding on a different part of the path, riding at different speeds, and accuracy of sensors detecting a rider's position (GPS accuracy can be around 5 meters). Increasing the distance of detection can help to ensure that all laps are properly marked but increases the possibility of incorrectly marking extra laps when traveling near the lap marker but in a different direction.

For example, if a path is configured as a FIG. 8, or if a path is configured such that two straightaways head in opposite directions, a rider may pass within a distance threshold of a position used to mark laps, but may not have completed a lap. Similarly, as additional splits are identified within a path, relying on an overbroad distance threshold may result in false positives.

There is a need for a lap marking system, device, or method, that accurately marks laps consistently but avoids false positives. There is a further need for such a system that maintains accuracy as split times are added.

SUMMARY

According to one aspect, a computer-based method for identifying a completed lap at a device is disclosed. The method includes retrieving or defining lap initiation data. The lap initiation data can include an initiation location and an initiation orientation. The method also includes retrieving or defining a location variance threshold for the initiation location and an orientation variance threshold for the initiation orientation. The method further includes determining, by a position determining module of the device, a first location of the device associated with a first time. The method also includes determining, by an orientation determining module of the device, a first orientation of the device associated with the first time. The method also includes identifying a lap as completed upon determining that the first location of the device is within the location variance threshold of the initiation location and that the first orientation of the device is within the orientation variance threshold of the initiation orientation.

DETAILED DESCRIPTION

Figure 1:
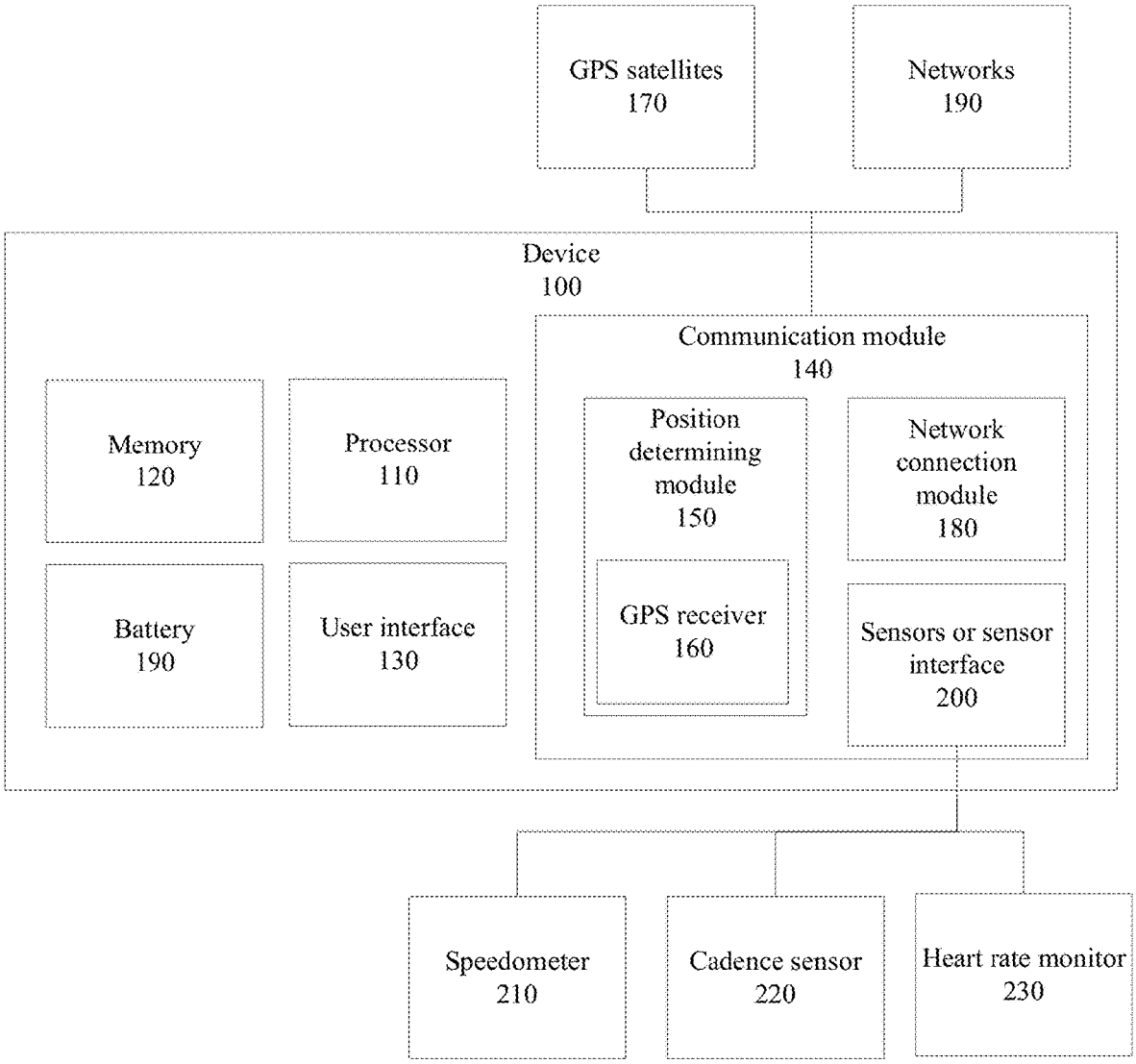
FIG. 1 shows a schematic representation of a device for implementing a method in accordance with this disclosure.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

This disclosure describes the best mode or modes of practicing the invention as presently contemplated. This description is not intended to be understood in a limiting sense, but provides an example of the invention presented solely for illustrative purposes by reference to the accompanying drawings to advise one of ordinary skill in the art of the advantages and construction of the invention. In the various views of the drawings, like reference characters designate like or similar parts.

While riding and utilizing a device implementing methods disclosed herein, subsequent updates to a rider's position from a position determining module, such as GPS, can be used to calculate the direction of their heading, which may be tracked in degrees from 0° to 360°, where 0° is North, 90° is East, 180° is South, and 270° is West. Heading can also be measured and received from other sensors in various embodiments of the device.

The methods disclosed herein use a directional component in combination with position tracking to more accurately and consistently mark laps. For each point where, if passed, a lap or a lap split should be automatically marked, an associated direction (in degrees) can also be stored. The additional direction parameter can be manually set by the user or determined based on a user's current direction of heading when manually marking a point. When it is detected that a rider passes near a point within the distance threshold the direction of heading is also compared with the stored direction associated with the point to prevent marking a lap when riding in a different direction.

FIG. 1 shows a schematic representation of a device 100 for implementing the methods described herein. In the embodiments discussed, the device 100 is generally a cycling computer or other navigation device, and is operable to provide navigation functionality to a cyclist. However, the device 100 may similarly be a device designed for other activities, such as cycling or driving, or it may be a general-purpose smartphone having navigation applications. Further, in some embodiments, the device may be a dedicated position determining device provided with features sufficient to implement the methods described herein. Such a minimalist device may be utilized, for example, in an organized race, where user lap times and splits are tracked by a beacon system or the like.

The device 100 is provided with a processor 110 and a memory 120. The processor 110 includes processing circuitry and provides processing functionality for the device 100, and may include any number of processors, microcontrollers, or other processing systems. The processor 110 may be formed from a variety of materials and components, and may execute the methods described herein.

The memory 120 may provide storage functionality, and may store various instructions and data associated with the operation of the device 110. Such instructions and data may include software programs for implementing the methods described herein, as well as data for supporting such software programs.

The memory 120 may be integral with or independent of the processor 110, and may take a wide variety of forms. For example, the memory may be non-removable memory elements, such as RAM, as well as ROM, Flash (such as removable memory cards), magnetic media, optical media, USB devices, and others. Data for use in the methods described herein may be provided on the memory 110 or may be provided independently in a database. Such data may include the instructions for operating an application implementing the methods described herein, as well as data for supporting such methods, such as mapping data and metadata, etc.

The device 100 is further provided with a user interface 130 through which a user interacts with the device. Such a user interface 130 may be, for example, a touch screen through which the user may enter commands and receive feedback. Such a touch screen may display maps and present the output of the route-based features discussed herein. The user interface 130 may include buttons instead of or in addition to touch-based features in the display, and the user interface may similarly include a display independent of any user control. For example, in the case of a cycling computer, a user may control the device by way of speech recognition software, or a user may control the device by buttons mounted on handlebars instead of at the device 100 itself. Similarly, the user interface 130 may be configured to incorporate gesture-based controls. The display may be any of a wide variety of standard displays, including LCD, LED, and any other type of display. The display is typically configured to present text and/or graphical information to the user.

Typically, applications implementing the methods described herein are stored in memory 120 and are executed by the processor 110. Such applications implement software user interfaces and users interact with the applications by way of the device 100 user interface 130.

The device 100 also provides a communication module 140 for providing access to devices and data sources independent of the device itself. The communication module 140 includes a position determining module 150, which typically takes the form of a GPS receiver 160, as discussed above. The position determining module may then receive signal data transmitted by one or more external data sources, typically GPS satellites 170. While GPS satellites 170 are illustrated, position data for geolocating the device 100 may take a wide variety of forms, such as positioning beacons for triangulating the device. In any event, the position determining module 150 is operable to determine a position through processing of data received from an external data source, such as geolocation utilizing GPS satellites 170.

Typically, the position determining module 150 provides data to the processor 110 which may then be used to implement a wide variety of basic features, including the illustration of a location on a map drawn from the memory 120. Similarly, the data may be used to determine a velocity and/or direction of movement for a user of the device, as discussed in more detail below.

The communication module 140 may further include a network connection module 180 for interfacing with an external network 190 as well as to send or receive information to a second iteration of the device 100 or a different device, such as a smartphone. The network communication module 180 may include a transceiver as well as components for operating the transceiver, such as one or more antennas, a wireless radio, data ports, and any required software interface for implementing communication protocols utilized by the network communication module 180. The external network may be a localized network and may be accessed by way of Wi-Fi or Bluetooth protocols, or it may be the internet accessed by way of a cellular provider, for example. In some embodiments, the device 100 networks with a user's smartphone by way of a Wi-Fi or Bluetooth connection and accesses the internet by way of the user's smartphone.

A battery 190 is provided in order to provide power to the other components of the device 100. Such a battery 190 may be built in to the device 100 and rechargeable or it may be removable for charging outside of the device or for replacement.

The device 100 may provide at least one sensor or sensor interface 200 for interfacing with external sensors. Such sensor interfaces 200 may allow the device to receive data from peripheral sensors, such as a speedometer 210, cadence sensor 220, heart rate monitor 230, and others. Such sensor interfaces 200 may be wired or wireless. It will be understood that sensors may be integrated into the device 100 as well, such as inertial sensors including accelerometers, directional sensors, such as a compass, and general orientation sensor. Such sensors, both internal to the device 100 and connected by way of the sensor interfaces 200, may support independent features of the device 100 as well as provide additional data by which the device 100 can infer directionality, as discussed in more detail below.

Figure 2:
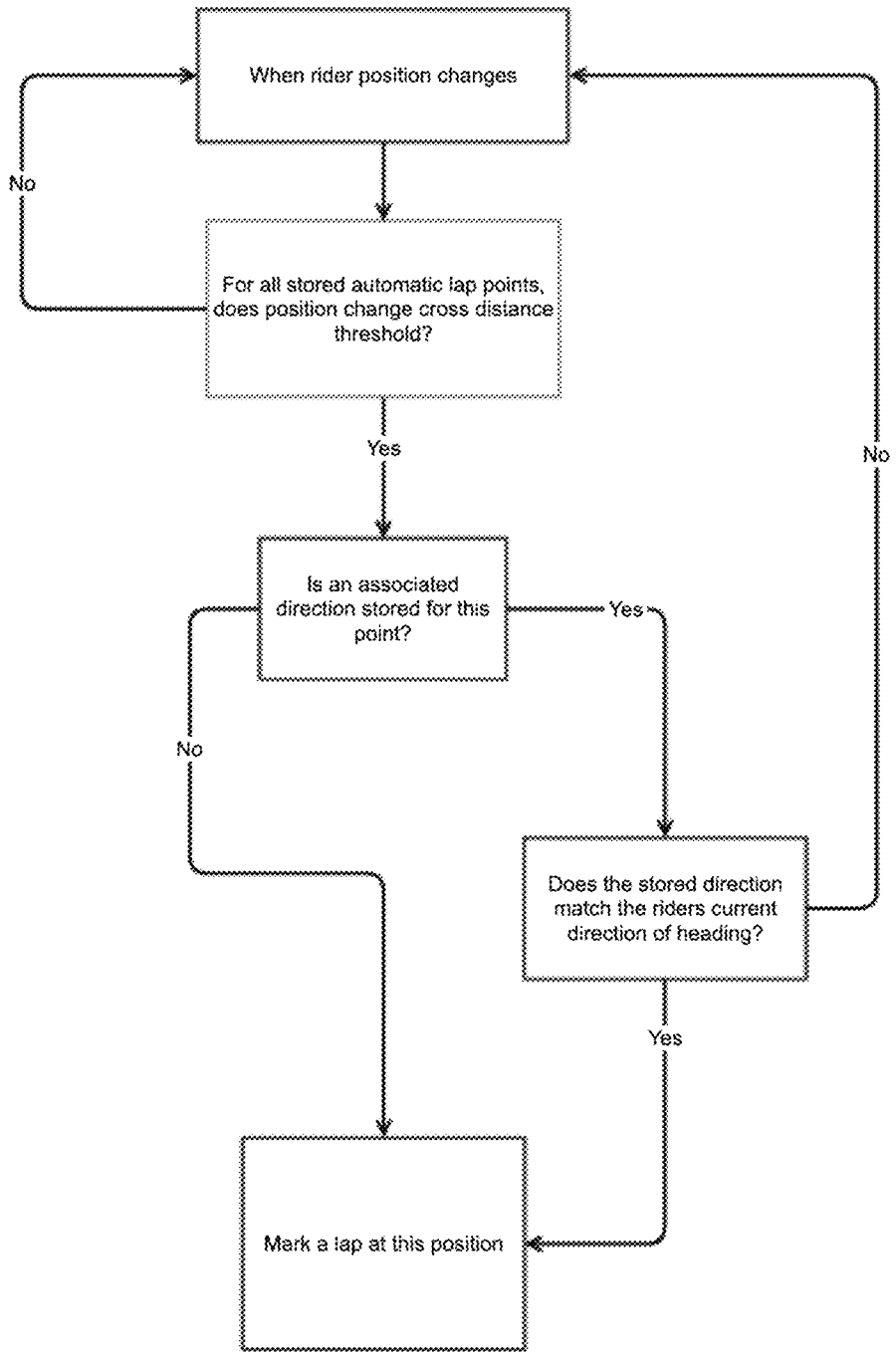
FIG. 2 is a flowchart illustrating a method in accordance with this disclosure.

FIG. 2 is a flowchart illustrating a method implemented with the device 100 in accordance with this disclosure. As shown, the method illustrated first evaluates when a rider position has changed and, upon making such a determination, the method determines if the position change results in the rider crossing within a distance threshold of an automatic lap point. If the rider has not crossed within the threshold distance of an automatic lap point, the method continues to monitor rider position changes.

Such automatic lap points may be, for example, a location identified as a lap initiation location or a location marked for a lap split time.

Once a rider has been determined to have crossed a distance threshold, the method determines whether an associated direction has been stored for this point. If no associated direction has been stored, then the method proceeds to mark the lap (or, in the case of a location marked for a lap split time, the appropriate split time).

In such an embodiment, where no direction has been stored, the sole criteria for marking a lap may then be the distance threshold which may, in turn, lead to false positives. Accordingly, as shown, where an associated direction has been stored, the method proceeds to determine if the riders current direction of heading corresponds to the stored direction. Just as in the case of the automatic lap points, which are provided with distance thresholds, the direction of heading may be provided with a variance threshold defining a variance within which a rider's current direction of heading is considered to match the stored direction.

Accordingly, only upon confirming that the current direction of heading matches the stored direction does the method proceed to mark a lap at that position. Otherwise, the method continues to monitor rider position changes.

Figure 3:
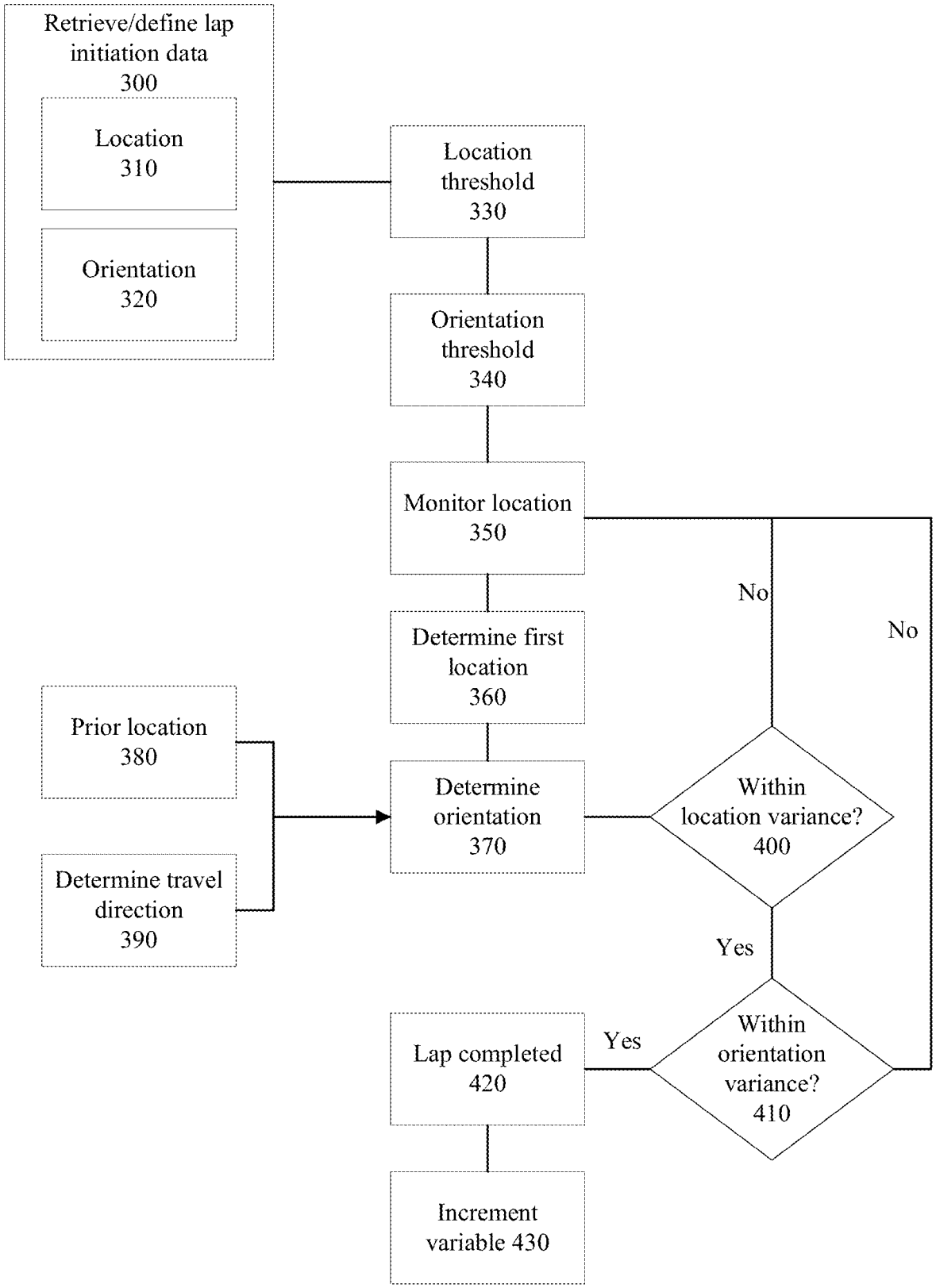
FIG. 3 is a flowchart illustrating a variation of the method in accordance with this disclosure.

FIG. 3 is a flowchart illustrating a variation of the method in accordance with this disclosure. As shown, the method is typically a computer-based method for identifying a completed lap at a device 100.

In the embodiment shown, the method first retrieves or defines lap initiation data (300) including an initiation location (310) and an initiation orientation (320). In addition to the lap initiation data, the method further retrieves or defines a location variance threshold (330) for the initiation location and an orientation variance threshold (340) for the initiation orientation.

The location variance threshold defines a maximum distance from the initiation location, such that if a location identified by the position determining module 150 is within the location variance threshold of the initiation location, the location will be considered the same, for purposes of certain determinations discussed below.

In some embodiments, the location variance threshold (defined at 330) is based at least partially on a geometry of a path containing the initiation location. As such, where the initiation location is a race course, certain characteristics of the course are considered in defining the location variance threshold. Accordingly, in some embodiments, the device 100 comprises a mapping module, which may be a software module, and the geometry of the path is then retrieved from path details in a map. Such maps and details may be retrieved from memory 120 or may instead be retrieved from databases accessible by way of the network connection module 180.

In some such embodiments, the geometry of the path utilized is a width of the path adjacent the initiation location. Accordingly, the location variance threshold may be defined (at 330) to correspond to a distance between the initiation location and an edge of the path farthest from the initiation location adjacent the initiation location in a lateral direction. As such, the location variance threshold should encompass any rider that passes the initiation location (defined at 310) while still within the path.

In some embodiments, the location variance threshold may be defined asymmetrically, so as to limit an effective zone to within a defined path. In other embodiments, the location variance threshold may be defined linearly, such that a rider must pass the initiation location in order to trigger a lap count, as discussed below. In some embodiments, including that discussed herein and shown below in FIG. 4, the location variance threshold is defined (at 330) as a radius about the initiation location, and the device 100 therefore does not attempt to determine a direction relative to the initiation location.

In some embodiments, the position determining module 150 is based on geolocation of the device 100 such as, for example, by way of a GPS receiver 160. In such an embodiments, the location variance threshold may be defined (at 330) at least partially based on an accuracy of the position determining module 150.

The orientation variance threshold typically defines a maximum angle between a defined linear direction corresponding to the initiation orientation and a direction of travel of the device 100 at the first time. In the example shown in FIG. 4, the orientation variance threshold may be defined as 45 degrees in each direction, such that a 90 degree range would still be considered within the orientation variance threshold of the initiation orientation.

In some embodiments, the location variance threshold and/or the orientation variance threshold are defined in advance and are retrieved from a database. Such thresholds may be fixed numbers, such as 45 degrees in each direction for the orientation threshold, or they may be defined based on user settings or characteristics of a path associated with the lap initiation data.

Similarly, the lap initiation data may be retrieved (at 300) from a database.

In some embodiments, the orientation variance threshold is defined (at 340) at least partially based on a geometry of the path along which the initiation location is located. Such mapping data, including geometry, may be known, as discussed above with respect to the defining of the location variance threshold. Accordingly, the geometry of the path considered may be, for example, a curvature of the path at or adjacent the initiation location. Where a path curves, riders pay take different lines through a turn, and more directional variance may thereby be expected.

Typically, although the orientation variance threshold may vary, a maximum orientation variance threshold would typically be 180 degrees, as a larger threshold would allow for parties traveling in opposite directions to satisfy a defined condition. In many embodiments, a maximum variance threshold may be set lower, such as at 90 degrees, as in the example of FIG. 4.

In some embodiments, the orientation variance threshold is defined (at 340) asymmetrically, such that a maximum angle defined by the orientation variance threshold in a first direction relative to the initiation orientation is larger than a maximum angle defined by the orientation variance threshold in a second direction relative to the initiation orientation. For example, in some embodiments, the orientation variance threshold may allow for a maximum of 90 degrees of variance, but may allow for 60 degrees of variance in a clockwise direction and only 30 degrees of variance in a counter-clockwise direction.

Such an asymmetric orientation variance threshold may be appropriate where, for example, the initiation location is at a curve, and as such, the degree of asymmetry allowed may be based on a curvature of the path at or adjacent the initiation location.

Once both the location variance threshold and orientation variance thresholds are defined, the method proceeds to monitor (350), using the position determining module 150 of the device 100 a current location of the device. Accordingly, the method then determines a first location of the device associated with a first time (360).

Similarly, the method may monitor, using an orientation determining module of the device 100, a first orientation of the device at the first time (370). While the position determining module 150 is typically a hardware device, such as a GPS receiver 160, the orientation determining module may instead be a software module. Further, the determination of orientation of the device may be based indirectly on sensor signals retrieved from elsewhere.

For example, the orientation determination may be based indirectly on the positions determined by the position determining module 150. In the embodiment shown, determining the first orientation of the device 100 at the first time comprises first determining or retrieving at least one prior location of the device 100 (380) associated with a time prior to the first time, determining a travel direction (390) based on a sequence of the at least one prior location and the first location, and defining the first orientation (at 370) based on the determined travel direction.

In some such embodiments, the travel direction is based on an extended sequence of a plurality of prior locations (at 380) of the device 100 associated with times prior to the first time and the first location. In such embodiments, the determining of the travel direction (at 390) may be based on a linear fit based on the extended sequence.

Once position and orientation of the device at the first time are determined (at 360, 370), the method determines whether the first location of the device 100 is within the location variance threshold of the initiation location (400) and further determines whether the first orientation of the device is within the orientation variance threshold of the initiation orientation (410). Upon determining that both criteria are within the threshold at the first time, the method identifies the lap as completed (420).

Alternatively, if either the first location or the first orientation are outside of the thresholds determined, the method continues to monitor (350) the current location of the device 100. It will be understood that the first time is not a specific time, but rather is a time conveniently chosen to correspond to the first location (defined at 360) and the first orientation (defined at 370) are within their thresholds such that the method identifies the lap as completed (at 420). Any time at which the method is proceeding and such conditions are not satisfied is therefore a time prior to the first time or follows the first time and is part of a later lap.

It will further be understood that the method described herein may continue to run iteratively, such that following the completion of a lap (at 420), the method proceeds to track future laps. In such embodiments, the "first time" may then represent a time in the context of the future lap being tracked at any given time.

Accordingly, in some embodiments, the method maintains a lap count and increments a variable (430) defining the lap count upon identifying a lap as completed (at 420).

In some embodiments, prior to the first time, the method monitors (350) on the current location (at 360) of the device 100 and not the current orientation of the device. The method then determines a current orientation (370) only upon determining that the current location of the device is within the location variance threshold of the initiation location.

In some embodiments, the lap initiation data may be defined (at 300) by a user at the user interface 130 associated with the device 100. In such an embodiment, the initiation location and the initiation orientation may be defined (at 310, 320) based on a current location and current orientation at a time when the user interacts with the user interface 130. For example, when a user wishes to initiate a lap count, the user may push a button, squeeze a trigger mounted on a bicycle handle, say a keyword, or otherwise indicate that a lap is beginning. The method may then set the lap initiation data (300) based on the user's location and orientation, and a lap may then conclude when the user returns to within the location variance threshold of that location while oriented within the orientation variance threshold of the initiation orientation.

The method is described as relating to completed laps. However, in some embodiments, the method may be applied to lap splits as well. Accordingly, a specified path may be provided with secondary location data, in addition to the lap initiation data. Such secondary location data may define a secondary location and a secondary orientation, and may be used to define splits for a lap being completed. Such secondary location data may be defined by users in real time, as discussed above, or may be identified in metadata associated with a map, or may be defined in the various other ways discussed above with respect to the lap initiation data.

Figure 4:
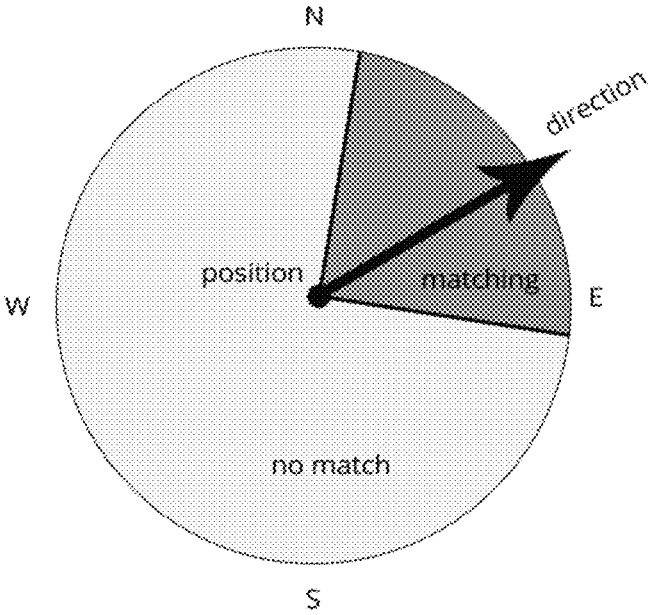
FIG. 4 illustrates how detection points are stored and thresholds by which they are checked.

FIG. 4 illustrates how detection points are stored and thresholds by which they are checked. As shown, the direction of heading is considered to match the stored direction when it is within 45 degrees in either direction of the lap initiation orientation, thereby offering a 90 degree range.

Figure 5:
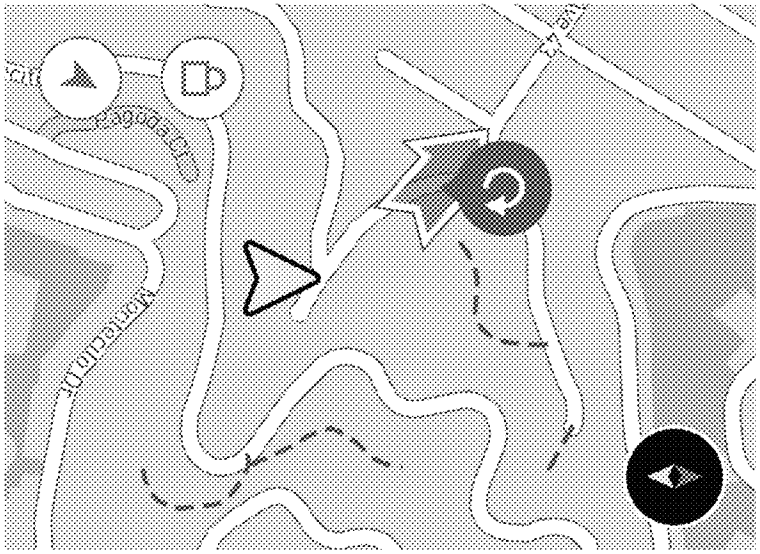
FIG. 5 illustrates a lap location marked on a map and associated with a direction in accordance with this disclosure.

FIG. 5 illustrates a lap location marked on a map and associated with a direction in accordance with this disclosure. By including the directional component in the automatic detection of laps, more accuracy can be achieved in marking lap points by increasing the distance without incorrectly marking extra laps when passing near the position in a different direction. Additionally, displaying the stored direction associated with an automatic lap position to the user can provide confirmation of the position placement with direction and confidence in where laps will be marked.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

While this specification contains many specifics, these should not be construed as limitations on the scope of the invention or of what may be claimed, but rather as descriptions of features specific to particular embodiments of the invention. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations and/or acts are depicted in the drawings and described herein in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that any described program components and systems can generally be integrated together in a single software product or packaged into multiple software products.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, are apparent to those of skill in the art upon reviewing the description.

The Abstract of the Disclosure is provided to comply with 37 C.F.R. § 1.72(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

Further, in some embodiments of the present invention, some or all of the method components are implemented as a computer executable code. Such a computer executable code contains a plurality of computer instructions that when performed in a predefined order result with the execution of the tasks disclosed herein. Such computer executable code may be available as source code or in object code, and may be further comprised as part of, for example, a portable memory device or downloaded from the Internet, or embodied on a program storage unit or computer readable medium. The principles of the present invention may be implemented as a combination of hardware and software and because some of the constituent system components and methods depicted in the accompanying drawings may be implemented in software, the actual connections between the system components or the process function blocks may differ depending upon the manner in which the present invention is programmed.

The computer executable code may be uploaded to, and executed by, a machine comprising any suitable architecture. Preferably, the machine is implemented on a computer platform having hardware such as one or more central processing units ("CPU"), a random access memory ("RAM"), and input/output interfaces. The computer platform may also include an operating system and microinstruction code. The various processes and functions described herein may be either part of the microinstruction code or part of the application program, or any combination thereof, which may be executed by a CPU, whether or not such computer or processor is explicitly shown. In addition, various other peripheral units may be connected to the computer platform such as an additional data storage unit and a printing unit.

The functions of the various elements shown in the figures may be provided through the use of dedicated hardware as well as hardware capable of executing appropriate software. When provided by a processor, the functions may be provided by a single dedicated processor, by a single shared processor, or by a plurality of individual processors, some of which may be shared. Explicit use of the term "processor" or "controller" should not be construed to refer exclusively to hardware capable of executing software, and may implicitly include, without limitation, digital signal processor hardware, processing circuitry, ROM, RAM, and non-volatile storage.

It is intended that the foregoing detailed description be regarded as illustrative rather than limiting and that it is understood that the following claims including all equivalents are intended to define the scope of the invention. The claims should not be read as limited to the described order or elements unless stated to that effect. Therefore, all embodiments that come within the scope and spirit of the following claims and equivalents thereto are claimed as the invention.

What is claimed is:

1. A computer-based method for automatically identifying a completed lap at a device comprising:

displaying a user interface on a display of the device;

retrieving or defining lap initiation data, the lap initiation data including an initiation location and an initiation orientation, wherein the initiation location and the initiation orientation are defined based on a current location and a current orientation on a path at a time when a user interacts with the user interface, the initiation location being defined based on GPS data obtained from a position determining module of the device and the initiation orientation being defined based on orientation data obtained from an orientation determining module of the device;

retrieving or defining a location variance threshold for the initiation location and an orientation variance threshold for the initiation orientation;

modifying the user interface to include graphical elements on a map to indicate that the initiation location and the initiation orientation have been set along the path;

displaying the modified user interface on the display of the device;

determining, by the position determining module of the device, a first location of the device associated with a first time along the path;

determining, by the orientation determining module of the device, a first orientation of the device associated with the first time along the path;

identifying a lap as completed upon determining that the first location of the device is within the location variance threshold of the initiation location and that the first orientation of the device is within the orientation variance threshold of the initiation orientation; and incrementing a lap counter in a memory of the device without user intervention once the lap is identified as completed.

2. The method of claim 1 wherein the location variance threshold defines a maximum distance from the initiation location.

3. The method of claim 2 further comprising defining the location variance threshold at least partially based on a geometry of the path containing the initiation location.

4. The method of claim 3 wherein the geometry of the path is a width of the path adjacent the initiation location.

5. The method of claim 4 wherein the location variance threshold is defined to correspond to a distance between the initiation location and an edge of the path farthest from the initiation location adjacent the initiation location in a lateral direction.

6. The method of claim 1 further comprises defining the location variance threshold at least partially based on an accuracy of the position determining module.

7. The method of claim 1 wherein the orientation variance threshold defines a maximum angle between a defined linear direction corresponding to the initiation orientation and a direction of travel of the device at the first time.

8. The method of claim 7 further comprising defining the orientation variance threshold at least partially based on a geometry of the path along which the initiation location is located.

9. The method of claim 8 wherein the geometry of the path is a curvature of the path at or adjacent the initiation location.

10. The method of claim 8 wherein a maximum orientation variance threshold comprises a 180 degree range about the initiation orientation.

11. The method of claim 8 wherein the orientation variance threshold is asymmetric, such that a maximum angle defined by the orientation variance threshold in a first direction relative to the initiation orientation is larger than a maximum angle defined by the orientation variance threshold in a second direction relative to the initiation orientation.

12. The method of claim 11 wherein the asymmetry of the orientation variance threshold is based on a curvature of the path at or adjacent the initiation location.

13. The method of claim 1 wherein determining the first orientation of the device comprises:

determining or retrieving at least one prior location of the device associated with a time prior to the first time;

determining a travel direction based on a sequence of the at least one prior location and the first location; and defining the first orientation based on the determined travel direction.

14. The method of claim 13 wherein the travel direction is based on an extended sequence of a plurality of prior locations of the device associated with times prior to the first time and the first location, and wherein the travel direction is a linear fit based on the extended sequence.

15. The method of claim 1 further comprising, prior to the first time, maintaining the current location of the device by the position determining module and determining the current orientation of the device only upon determining that the current location of the device is within the location variance threshold of the initiation location.

16. The method of claim 1, wherein the lap initiation data, the location variance threshold, or the orientation variance threshold is retrieved from a database, and the retrieved data is associated with path information associated with the lap initiation data.

17. The method of claim 1 further comprising retrieving secondary location data including a secondary location and a secondary orientation, and wherein the secondary location data defines splits for a lap being completed.

* * * * *